United States Patent [19]

Kankaanpaa

[11] 4,024,015

[45] May 17, 1977

[54] WEB-FORMING METHOD AND APPARATUS

[75] Inventor: Matti Kankaanpaa, Tapiola, Finland

[73] Assignee: Valmet Oy, Helsinki, Finland

[22] Filed: Dec. 6, 1973

[21] Appl. No.: 422,412

[30] Foreign Application Priority Data

Dec. 7, 1972 Finland ..... 723461

[52] U.S. Cl. ..... 162/203; 162/208; 162/211; 162/212; 162/217; 162/307; 162/315; 162/317; 162/318; 162/335; 162/336; 162/347; 162/357

[51] Int. Cl.[2] ..... D21F 11/04

[58] Field of Search ..... 162/203, 211, 212, 315, 162/347, 318, 336, 357, 307, 208, 297, 317, 217, 206, 214, 335

[56] References Cited

UNITED STATES PATENTS

| | | | |
|---|---|---|---|
| 1,867,930 | 7/1932 | Traquair | 162/357 |
| 3,055,496 | 9/1962 | Dunlap | 162/206 |
| 3,056,719 | 10/1962 | Webster | 162/318 |
| 3,272,692 | 9/1966 | Hayes et al. | 162/317 |
| 3,397,112 | 8/1968 | Highton et al. | 162/318 |
| 3,485,715 | 12/1969 | Kobayashi | 162/318 |
| 3,695,996 | 10/1972 | Frezzotti | 162/357 |
| 3,734,821 | 5/1973 | Curtis | 162/317 |

*Primary Examiner*—S. Leon Bashore

*Assistant Examiner*—Peter Chin

*Attorney, Agent, or Firm*—Steinberg & Blake

[57] ABSTRACT

A web-forming method and apparatus particularly suited for cellulose pulp. The web is initially formed on a rotary wire cylinder which has a horizontal axis and a crest situated at the highest part of the cylinder over the horizontal axis, the cylinder during rotation thus having an upwardly travelling side which turns upwardly toward the crest and a downwardly travelling side which turns downwardly from the crest. At the upwardly travelling side of the cylinder is a headbox having its slice situated adjacent the crest for projecting onto the rotating cylinder a pulp slurry jet at a speed greater than the peripheral speed of the cylinder, so that the deposited pulp slurry will start to form a web while turning with the cylinder up to and then downwardly from the crest thereof. An outer wire has a portion wrapped partially around the cylinder, through an angle of at least 180°, and the web which initially forms freely on the cylinder is compressed between the outer wire and the cylinder with the outer wire travelling with the cylinder, so that in this way dewatering is accelerated. The outer endless wire is guided around a pickup roll to travel onto the latter from the cylinder while continuing to carry the web, so that in this way the web is detached from the cylinder and is carried away from the latter with the outer wire before the latter returns to the cylinder.

20 Claims, 2 Drawing Figures

WEB-FORMING METHOD AND APPARATUS

BACKGROUND OF THE INVENTION

The present invention relates to web-forming methods and apparatus particularly designed for the handling of cellulose pulp.

In sheet-forming and dewatering machines of this type, after the web-forming operation, the resulting pulp sheet is first wet-pressed and then dewatered either by means of drying cylinders or in a blower dryer. The wet end, or the web-forming part of the machine, is conventionally of the well known fourdrinier design having a flat wire on which the sheet forms. On such a flat wire the cellulose pulp web which is to be manufactured usually has a weight of about 600–1000 g/m$^2$, and the web which is formed can be endowed with structural and strength characteristics which in the first place are appropriate with respect to the operation of the drying machine.

It is well known that when paper is manufactured with a fourdrinier, the continuous velocity of the pulp slurry jet which discharges from the slice of the headbox onto the travelling flat wire may differ appreciably from the speed of the wire. Thus, the speed of travel of the pulp slurry jet may be as much as 20% above or below the speed of travel of the wire, without any major difficulties resulting from this differential in the operation of the machine itself. However, the velocity differential is normally plus or minus 5%. On the other hand, the characteristics of the paper itself, for example the uniformity of the paper structure or the cloudiness thereof, or the ratio of the cross-machine and machine-direction strengths of the paper, are greatly dependent upon the velocity ratio, as has been set forth e.g. in the Journal Paperi ja Puu, 1967, No. 4*a*, page 148.

On the other hand, when a cellulose web is formed with a fourdrinier wet end, it has been recognized that the velocity of the pulp slurry jet must of necessity always be considerably in excess of the linear travelling speed of the wire, with the differential in this case being up to twice the wire speed, so that it is possible to achieve in this way a pulp web capable of travelling in a zig-zag path first in one direction and then the other around and between rolls and cylinders without breaking. If it is attempted to form a cellulose web at the same velocity ratio as in paper-making operations referred to above, it is not possible for the cellulose web to travel through the machine without breaking. It appears that only as a result of the excess velocity of the unbeaten cellulose fibers can the latter form a pulp web of sufficient solidity to tolerate the stresses to which the web is subjected, for example, on drying cylinders and rolls. It may be mentioned in this connection that the thickness of a pulp web formed on a flat fourdrinier wire is usually on an order which will provide a weight of 1200 g/m$^2$ at the most.

It is known to use as a cellulose sheet-forming machine, for handling wet slurries, a Kamyr lifting cylinder, or in other words instead of a fourdrinier machine a cylinder machine where a mold cylinder rotates in a vat which contains the pulp slurry. A wet end of this type is also used under certain circumstances with blower dryers, particularly when forming very thick webs which have a weight of between 1500 and 2000 g/m$^1$. In order to form relatively thin cellulose webs, however, having a weight of less than 900 g/m$^1$, the Kamyr lifting cylinder is not suitable, primarily because of difficulties encountered in the pressing phase which follows the web-forming phase. It should be noted in general that the rotary lifting or mold cylinder rotates in a vat or basin which is filled with pulp slurry, and therefore the possibilities for controlling web-formation are rather restricted, so that the Kamyr type of machine is not able to operate under running conditions according to which factors such as the cellulose pulp speed and base weight can be selected within wide limits.

SUMMARY OF THE INVENTION

It is accordingly a primary object of the present invention to provide a method and apparatus which will avoid the above drawbacks.

Thus, it is an object of the present invention to provide a web-forming method and apparatus according to which a cellulose sheet former is capable of operating at high speeds with the base weight of the web which is formed being virtually freely selectable so as to be appropriate for any particular application required by a particular customer.

Thus, it is an object of the present invention to provide in connection with the web-forming part of a sheet-forming and dewatering machine for cellulose pulp, running conditions such as speed of the pulp web, and in particular, the base weight thereof which are capable of being varied within wide limits.

In addition it is an object of the present invention to provide a method and apparatus which are adjustable at various parts so as to achieve different characteristics for the resulting product.

Furthermore, it is an object of the present invention to provide a method and apparatus characterized by great reliability in operation as well as simplicity in construction.

With the present invention use is made of features known from Kamyr lifting cylinders and from suction filters, which have been applied in a new way in modern twin-wire former type of machines.

According to the present invention, the wet-forming method includes the steps of directing a pulp slurry jet into a rotating wire cylinder with a horizontal axis and a crest situated over this axis, the jet being directed substantially tangentially with respect to the cylinder in the direction of rotation thereof at a location adjacent but situated in advance of the crest, considered in the direction of rotation of the cylinder, so that the pulp jet after initially engaging the wire cylinder turns with the latter upwardly to the crest and then downwardly beyond the crest. The web which thus initially forms on the cylinder is then compressed between the wire cylinder and an outer wire which is wrapped partially around the wire cylinder through an angle of at least 180°, after the deposited pulp has travelled beyond the crest through a given angle prior to being compressed. Then the outer wire with the compressed pulp thereon is guided around a pickup roll situated adjacent the wire cylinder.

The web-forming apparatus of the invention thus includes a rotary wire cylinder means for participating in the formation of a web as its exterior surface. This cylinder means has a horizontal axis and over its axis, as its uppermost part, a crest which is situated between opposite sides of the cylinder means which respectively travel upwardly and downwardly away from the crest while the cylinder means rotates in a given direction. A headbox means has a slice situated at the upwardly travelling side of the cylinder means adjacent the crest thereof for directing a pulp slurry jet onto the cylinder means to be carried thereby from the slice upwardly through and beyond the crest and then downwardly beyond the latter at the downwardly travelling side of the cylinder means. An endless outer wire means is wrapped partially around the wire cylinder means through an angle of at least 180°with repect to the axis for compressing the web on the cylinder means between the latter and the outer wire means during rotation of the cylinder means. This outer wire means travels together with the cylinder means at the part of the outer wire means which is wrapped partially around the cylinder means to constitute a twin-wire former with the cylinder means. A rotary pickup roll means is situated beside the cylinder means at the upwardly travelling side thereof at a greater distance from the crest than the headbox means so that the latter is situated between the pickup roll means and the crest. The outer wire means extends from its portion which is wrapped partially around the cylinder means partially around the pickup roll means to be partially guided thereby while supporting the web upon separation of the latter from the cylinder means.

Thus, the apparatus of the invention is made up of a plurality of components. One of these components is a headbox which has its slice adjacent to the wire cylinder at a sector which extends from the crest thereof in a direction opposite to its direction of rotation, with this sector having a predetermined size. The pulp slurry jet is discharged through the slice onto the cylinder tangentially with respect thereto in the same direction that the cylinder rotates. A coarse-mesh outer wire is wrapped partially around the wire cylinder at the exterior of the latter along a sector of a given size which is not less han 180° around the axis of the cylinder. This sector where the deposited web is received between the outer wire and the cylinder starts only at a given angular distance in the direction of rotation of the cylinder from the slice. The cellulose web is thus forced to travel along the sector where the outer wire is partially wrapped around the wire cylinder, being compressed between the wire and the cylinder. A pickup roll, which communicates with a suction source, is situated adjacent the wire cylinder and guides the outer wire from the wire cylinder, with the cellulose web being carried away from the cylinder by the outer wire as the latter travels over the pickup roll. At the region where the web is detached from the cylinder the latter is provided with a source of air at greater than atmospheric pressure directed outwardly away from the cylinder axis through the cylinder against the web so as to facilitate the detaching of the cellulose web from the cylinder.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
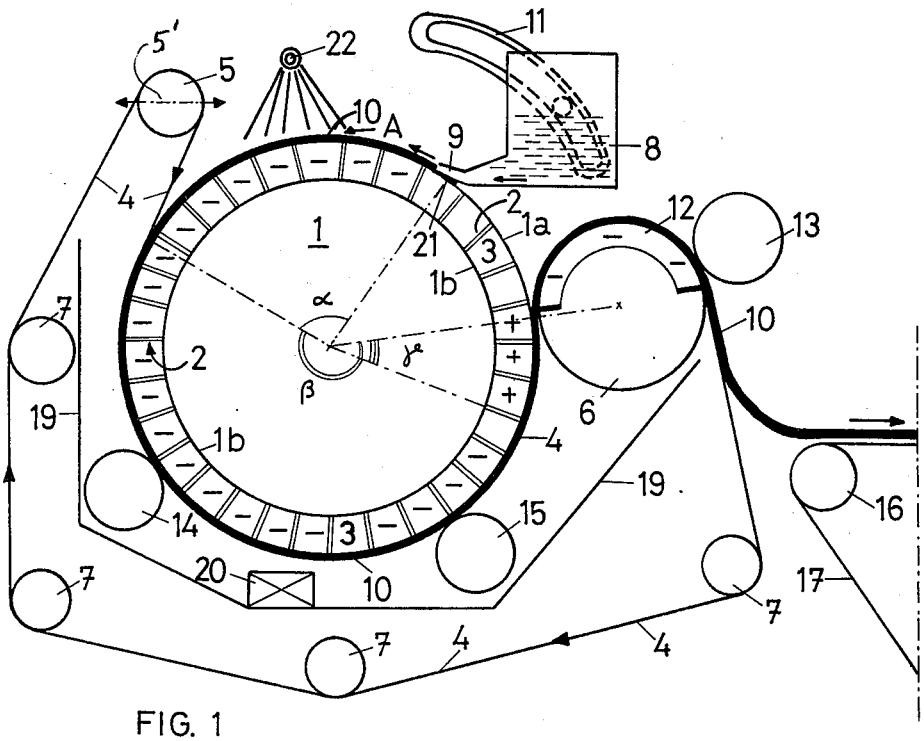
FIG. 1 is a schematic elevation illustrating one possible method and apparatus according to the invention.

Referring to FIG. 1 it will be seen that an outer endless wire means 4 is tangent to the rotary wire cylinder means 1 and is wrapped partially around the latter through an angular sector $\beta$ which is not less than 80° around the horizontal axis of the cylinder 1. The outer endless wire 4, which has a relatively coarse mesh, as set forth above, is guided by a plurality of guide rolls 5–7. The size of the angular sector $\beta$ is preferably and most appropriately approximately 210°. A suitable adjusting means 5′, designated by the horizontal dot-dash line passing through the axis of the roll 5 and terminating in the arrowheads, is operatively connected with the guide roll 5 for adjusting the horizontal position thereof, and in this way it is possible to adjust the size of the angular sector $\beta$ within certain limits.

The pulp slurry jet issues from the slice 9 of the headbox means 8 to tangentially contact the outer surface of the wire cylinder means 1 at a velocity substantially greater than the peripheral velocity of the cylinder 1. The speed of discharge of the pulp slurry jet from the slice 9 is preferably approximately twice as great as the peripheral speed of the cylinder 1. Thus, the pulp slurry jet issues in the same direction that the cylinder 1 rotates, namely a counterclockwise direction, as viewed in FIG. 1, and thus the pulp slurry jet is deposited on the cylinder 1 to start the formation of the web. In this way a cellulose web 10 starts to be formed on the rotating wire cylinder 1.

It is to be noted that the wire cylinder 1 has a horizontal axis with the uppermost part of the wire cylinder forming a crest situated over this axis. In this way on the right side of the crest the cylinder 1 has an upwardly traveling side while at the left of the crest the cylinder 1 has a downwardly traveling side. The slice 9 is situated at the upwardly traveling side of the cylinder 1 at the region of the crest that the initially deposited web travels upwardly toward the crest and then downwardly beyond the latter.

The cylinder means 1 has an outer wire wall 1*a* of suitable mesh which coaxially surrounds and is spaced outwardly of an inner solid wall 1*b* so that these cylinder walls 1*a* and 1*b* define an annular space which surrounds the cylinder axis. This space is divided by radial partitions 2 into a plurality of axially extending compartments 3. These compartments 3 which are thus formed between the foraminous outer wall 1*a* and the closed inner wall 1*b* communicate at one or both ends of the cylinder in a known way through a suitable cabinet system with a suction means which will produce a given degree of vacuum and partly with a means for producing a flow of air at higher than atmospheric pressure. Those compartments 3 which at any given instant communicate with the source of suction so as to be at less than atmospheric pressure are designated with a minus sign while those compartments 3 which at any given instant communicate with the source of air at greater than atmospheric pressure are designated by a plug sign. Thus, the compartments 3 which at any given instant have the plus sign form part of a means for directing air at greater than atmospheric pressure outwardly away from the axis of the cylinder 1 through the foraminious outer wall thereof while those compartments which at any given instant have the illustrated minus signs form part of a suction means for drawing air inwardly through the web and outer foraminous wall toward the axis of the cylinder. Thus it will be noted that form the slice 9 in the direction of rotation of the cylinder around and beyond the crest thereof the compartments are under vacuum so that dewatering of the initially deposited web commences immediately upon engagement of the jet issuing from the slice 9 with the outer wall of the cylinder. In addition a gravity-induced dewatering takes place. As a result of these actions the initially deposited pulp slurry has time within the angular sector $\alpha$ to reach a sufficient compactness before reaching the sector $\beta$ where the web is compressed between the outer wire wall of the cylinder 1 and the endless wire means 4, so that twin-wire forming then takes place with further dewatering of the cellulose web in two directions as a result of the fact that those compartments 3 which at any given instant are in the angular sector $\beta$ are also maintained at a given vacuum.

The size of the initial forming angular sector $\beta$ may vary within limits of approximately 45°–150°. The pressure between the endless outer wire 4 and the cylinder 1 may be controlled by adjusting the tension of the outer endless wire 4. For example the guide roll 5 may be adjusted by the guide means 5' in the manner described above for this purpose. In order to promote dewatering in the initial web-forming sector $\beta$ it is possible to situate over this sector an apertured pipe system 22 or the like which serves to issure hot water jets onto the web, acting in a manner well known in the art to promote dewatering at this region.

In order to detach the cellulose web 10 from the rotary cylinder means 1, after the web has been compacted in the sectors $\alpha$ and $\beta$ of the cylinder 1, the outer endless wire 4 is guided from the cylinder 1 over the pickup roll means 6, and at the sector $\gamma$ around the axis of the cylinder 1 the compartments 3 communicate with a source of air at greater than atmospheric pressure for facilitating detachment of the web from the cylinder at the region where the outer wire 4 travels from the cylinder onto the pickup roll means 6. As a further aid in the conveying of the cellulose web 10 the pickup roll means 6 has a known suction zone 12 acting to produce a suction directed through the web and the outer wire 4 inwardly toward the axis of the roll 6.

In order to further increase the extent of dewatering beyond the cylinder 1 in connection with the pickup roll means 6, a press roll 13 is provided to press the web toward the outer wire 4, while the latter and the web 10 travel through the nip between the rolls 6 and 13. After traveling through this latter nip the cellulose web 10 is directed away from the endless outer wire 4 onto a felt 17 guided by suitable rolls such as the illustrated guide roll 16, this felt 17 conveying the cellulose web 10 into a press section which is not illustrated and which forms part of the web-forming wet end of the machine illustrated in FIG. 1.

Figure 2:
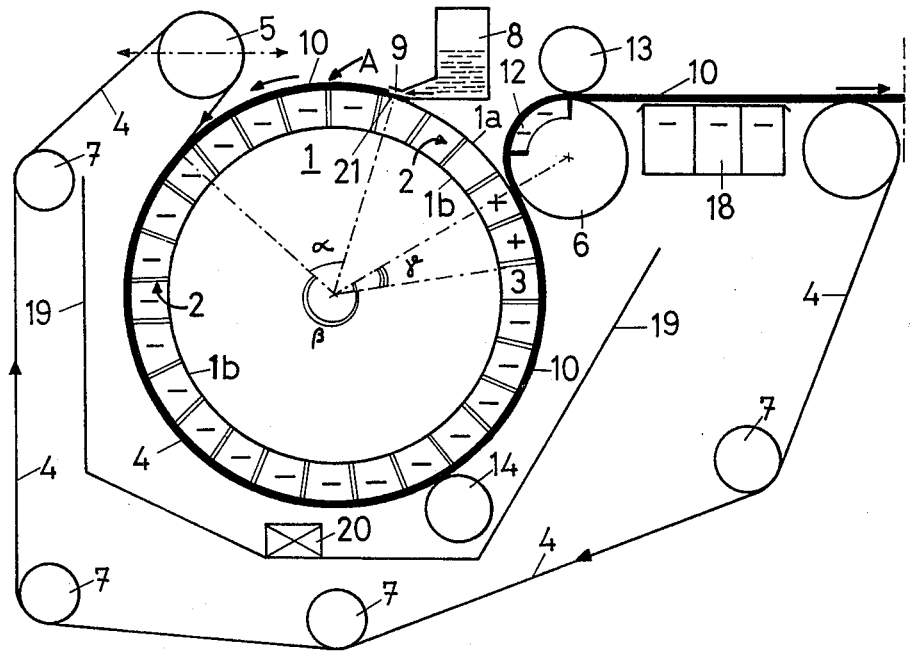
FIG. 2 is a schematic elevation illustrating another possible method and apparatus according to the invention.

However, it is possible instead to provide a method and apparatus as illustrated in FIG. 2 according to which the outer wire means 4 is guided beyond the nip between the rolls 6 and 13 along a horizontal path around an additional guide roll 7 with a suction means 18 being situated beneath the outer wire at its region which travels horizontally to the right beyond the pickup roll means 6, as viewed in FIG. 2. In this way the web 10 is acted upon by additional suction when traveling beyond the pickup roll means 6. The suction means 18 may take the form of suitable suction boxes or equivalent zonal suction devices. Then with the embodiment of FIG. 2 the web is detached from the wire 4 and is delivered to the felt 17 while the wire 4 returns along the several guide rolls 7 to the guide roll 5 and then from the latter back to the portion which is wrapped partially around the cylinder means 1. It will be noted that the guide roll 5 has been adjusted to a different position in FIG. 2 and in FIG. 1.

As may be seen from FIG. 1 the headbox means 8 is adjustable around the axis of the cylinder means 1 by a suitable adjusting means 11. Thus the adjusting means 5' and the adjusting means 11 are available so that either one or both of these adjusting means may be utilized for adjusting the angle $\alpha$, and it will be noted that this angle has been adjusted by shifting of both roll 5 and the headbox means 8 to assume the position of FIG. 2 as compared with the position of these components illustrated in FIG. 1.

It is also possible to further increase the extent of dewaterng in association with the cylinder 1 by providing one or more additional press rolls 14 and 15 which engage the outer wire 4 at the region thereof which is wrapped partially around the cylinder means 1.

A saveall 19 is situated between the upper and lower runs of the endless outer wire 4 for catching the material which falls downwardly through the wire 4 during dewatering of the web between the wire 4 and the cylinder 1. Thus, the escaping water which is received by the savewall 19 will reach a drain pipe 20 which is schematically illustrated.

It is apparent that the portion of the cylinder 1 which is located just beneath the lower lip of the slice 9, corresponds to a conventional breast roll, and FIG. 1 illustrates an apron rubber means 21 which is carried by the lower lip of the slice 9.

As a result of the above-described web-forming method and apparatus of the invention, with the numerous possible adjustments thereof, the speed of operation of the web-former and the base weight of the cellulose web may be selected within very wide limits. The sizes and mutual proportions of the sectors $\alpha$ and $\beta$ of the cylinder 1 depend upon the operating conditons referred to above. While the size of the sector $\alpha$ may be altered by changing the positions of both the guide roll 5 and the headbox 8, or either one of the latter, it is to be noted that if the guide has its position changed for this purpose there will also be a change of sector $\beta$. The efficiency of the dewatering action taking place at the cylinder 1 is capable of being influenced, above all, by adjusting the tension of the outer wire means 4 and the degree of vacuum in the compartments 3, this degree of vacuum being adjusted in a well known manner while the tension of the outer wire 4 may be adjusted by adjusting the position of the guide roll 5 as pointed out above.

The wire cylinder means 1 preferably has a diameter of between 2.5 and 5 meters, so that with this relatively large cylinder relatively high peripheral speeds will be achieved even when the cylinder means 1 rotates at a relatively small number of revolutions per minute.

The method and apparatus of the invention described above are known in some respects in the manufacture of multi-ply cardboard. Reference in this connection may be made to U.S. Pat. No. 3,485,715 of Tadashi Kobayashi of Japan. The web forming method and apparatus of the present invention differs from the Kobayashi former (referred to below as KF) not only with respect to the different use but also with respect to various structural features. Thus, the KF headbox is situated at the crest of the cylinder. With the KF construction there is no outer wire. Instead a felt is used. If a wire were to be used it would have to have an extremely fine-mesh forming a wire fabric of very fine mesh. Thus, the use of an outer endless wire means of relatively coarse mesh is different from the KF construction.

In addition, in the KF construction suction is used in the dewatering zone to the extent which is considerably less than with the present invention, because with the KF machine it is essential that the web retain sufficient moisture where one web is joined to another so that the completed cardboard will not split. Thus with the KF arrangement the web cannot be too dry. Furthermore, with the KF construction the escaping water accumulates at the lower part of the cylinder from where during high speeds it will rise and interfere with the operation of the cylinder. Also, with the KF construction the cylinder diameters are smaller than with the construction of the present invention. Thus the KF cylinder diameters are on the order of 1.5 meters while the present invention the cylinder diameter is 2.5–5 meters.

It is important in the operation of the wet end of the web-former of the present invention that the web be formed on a relatively large diameter wire cylinder, on the order of 2.5–5 meters, under fully controlled conditions particularly with respect to the relationship between the peripheral velocity of the cylinder and the velocity of the pulp slurry jet which discharge from the slice of the headbox. It is as a result of this latter feature of the present invention that the pulp web which is formed has a very coherent structure and that it it possible to achieve an extremely reliable operation of the cellulose sheet-forming machine at all of its components even at high speeds of operation.

It is to be noted that initially, between the slice 9 and the outer wire means 4, which is to say in the angular range $\alpha$, the web is formed by being subjected only to suction at this first dewatering phase. It is during this initial freeforming phase that the web has an opportunity and time to acquire a structure and strength which enable it to withstand in a highly effective manner the subsequent phases of the treatment. The second dewatering phase commences when the web reaches the angular range $\beta$ where it is compressed between the outer wire means 4 and the cylinder means 1, and at this time the web is compressed in accordance with a twin-forming operation without any damage to the web and with the dewatering taking place at this time outwardly through the outer wire.

I claim:

1. In a cellulose web-forming method, the steps of directing only a single pulp slurry jet containing unbeaten cellulose fibers onto a rotating wire cylinder, which has a diameter on the order of 2.5–5 meters a horizontal axis and a crest situated over said axis, substantially tangentially with respect to the cylinder in the direction of rotation thereof at a velocity substantially greater than the peripheral velocity of the wire cylinder and at a location adjacent but situated in advance of said crest, considered in the direction of rotation of the cylinder, by an angle at least great enough to provide for the pulp jet after initially engaging the wire cylinder an appreciable extent of travel with the cylinder upwardly in opposition to gravititational resistance while turning through several degrees around said axis to said crest and then beyond the crest downwardly from the latter, then compressing the deposited pulp between the wire cylinder and an outer wire which is wrapped partially around the wire cylinder through an angle of at least 180° but substantially less than 360°, after the deposited pulp has traveled beyond said crest through a given angle prior to being compressed, said compression of the pulp and the travel thereof around said axis producing a dewatering of the pulp in a direction outwardly away from said axis, dewatering the pulp in a direction inwardly toward said axis simultaneously with the outward dewatering thereof, then guiding the outer wire with the compressed pulp thereon, before reaching the location where the pulp slurry jet is directed onto the wire cylinder, around a pickup roll situated adjacent the wire cylinder, returning the outer wire from said pickup roll back to the rotating cylinder, with the latter being the only wire cylinder with which said outer wire cooperates, while simultaneously directing the cellulose web from said outer wire to a press section, while subjecting the pulp jet from the time that it initially engages the wire cylinder until it enters between the wire cylinder and the outer wire only to suction, forming in this way an initial free-forming phase where the web has an opportunity and time to acquire a structure and strength enabling it to for the initially freee forming web prior to compression thereof withstand the subsequent phases of treatment, while providing for the initially free forming web prior to compression thereof on the wire cylinder an angular range of 45°–150° and directing the pulp slurry jet onto the rotating wire cylinder at a location within a range from said several degrees up to 60° in advance of said crest.

2. In a method as recited in claim 1 and wherein air at greater than atmospheric pressure is directed outwardly away from said axis through the wire cylinder at the region where the outer wire and the compressed pulp thereon travels to the pickup roll for facilitating separation of the web from the cylinder.

3. In a method as recited in claim 1 and wherein the outer wire and the web thereon is guided beyond the pickup roll along a path where suction is applied to the web through the outer wire.

4. In a method as recited in claim 1 and wherein the velocity of the pulp slurry jet is approximately twice the peripheral velocity of the wire cylinder.

5. In a method as recited in claim 1 and wherein the tension of the outer wire and thus the compression of the web between the latter and the wire cylinder is adjusted for at least partially determining the rate of dewatering.

6. In a method as recited in claim 1 and wherein at least one press roll engages the outer wire and presses the latter toward the wire cylinder for increasing the rate of dewatering.

7. In a method as recited in claim 1 and wherein, for said inward dewatering, suction is also applied through the deposited pulp inwardly toward said axis through the angle where the deposited pulp is compressed between the outer wire and the wire cylinder and the outer wire.

8. In a method as recited in claim 1 and wherein the travel of the outer wire and the web thereon around the pickup roll is accompanied by application of suction through the web and outer wire inwardly toward the axis of the pickup roll.

9. In a method as recited in claim 1 and wherein hot water jets are applied to the pulp deposited on the wire cylinder prior to compression of the deposited pulp between the wire cylinder and the outer wire at a temperature sufficient to promote dewatering.

10. In a web-forming apparatus, particularly adapted to form a cellulose web from a pulp slurry jet containing unbeaten cellulose fibers, rotary wire cylinder means for participating in the formation of a web at its exterior surface, said cylinder means having a diameter on the order of 2.5–5 meters a horizontal axis and over its axis at its uppermost part a crest situtated between opposed sides of said cylinder means which respectively travel upwardly toward and downwardly away from said crest while said cylinder means rotates around said axis in a given direction, headbox means having a slice situated at the upwardly traveling side of said cylinder means adjacent but spaced at least at a substantial angle in advance of said crest thereof for directing a pulp slurry jet onto said cylinder means at a velocity substantially greater than the peripheral velocity of said cylinder means to be carried thereby from said slice upwardly through and beyond said crest and then downwardly beyond the latter at the downwardly traveling side of said cylinder means, said headbox means being the only headbox means which cooperates with said wire cylinder means, endless outer wire means wrapped partially around said wire cylinder means through an angle of at least 180° but substantially less than 360° with respect to said axis for comprssing the web on said cylinder means between the latter and said outer wire means during rotation of said cylinder means, said outer wire means traveling together with said cylinder means at the portion of said outer wire means which is wrapped partially around said cylinder means to consitute a twin-wire former with said cylinder means, rotary pickup roll means situated beside said cylinder means at the upwardly traveling side thereof at a greater distance from said crest than said headbox means so that the latter is situated between said pickup roll means and said crest, said outer wire means extending from its portion which is wrapped partially around said cylinder means partially around said pickup roll means to be partially guided thereby while supporting the web upon separation from said cylinder means, means returning said outer wire means from said pickup roll means back to said cylinder means, said cylinder means being the only cylinder means which cooperates with said outer wire means, the compression of the web between said cylinder means and said endless outer wire means and the travel of the web around said axis both acting to provide a dewatering of the web directed outwardly away from said axis, suction means acting on said web situtated between said cylinder means and endless outer wire means for providing an inwardly directed dewatering of the web simultaneously with said outwardly directed dewatering thereof, means separating the web from said outer wire means at the region of said pickup roll means and for directing the web toward a press section, an initial forming angle being defined between said slice of said headbox means and the location where the outer wire means first engages the web on said cylinder means, said initial forming angle having a size around said axis of between 45° and 150°, means for subjecting the web at said initial forming angle only to suction, said initial forming angle being sufficiently great to provide the web with an opportunity and time to acquire a structure and strength which will enable the web to withstand subsequent phases of treatment thereof, said slice of said headbox means being situated from said crest at an angle from said substantial angle up to 60° with respect to said axis.

11. The combination of claim 10 and wherein said cylinder means includes a means for directing air at greater than atmospheric pressure outwardly away from said axis of said cylinder means through the latter at the region where said outer wire means travels from said cylinder means to said pickup roll means, for facilitating separation of the web from said cylinder means.

12. The combination of claim 11 and wherein said cylinder means includes an outer foraminous cylindrical wall and an inner closed cylindrical wall coaxial with said foraminous wall and defining an annular space therewith, a plurality of radial partitions in said space dividing the latter into circumferentially distributed compartments some of which at any given instant are situated at the region where said outer wire means travels from said cylinder means to said pickup roll means and form part of the means for directing air at greater than atmospheric pressure outwardly away from said axis while other compartments form part of said suction means for applying suction through the web on said outer wall inwardly toward the axis of said cylinder means.

13. The combination of claim 10 and wherein a plurality of guide roll means cooperate with said endless outer wire means for guiding the latter from said pickup roll means back to said cylinder means, one of said plurality of guide roll means cooperating with said pickup roll means for directing the outer wire means with the web thereon along a predetermined path from said pickup roll means, and suction means situated at the latter predetermined path for applying suction through the web on said outer wire means as it travels between said pickup roll means and said guide roll means.

14. The combination of claim 10 and wherein a plurality of guide roll means cooperate with said endless outer wire means for guiding the latter from said pickup roll means back to said cylinder means, said plurality of guide roll means including one guide roll means from which the endless outer wire means travels to said cylinder means for engaging the web, said one guide roll means and said headbox means forming a pair of means, and adjusting means operatively connected with at least one of said pair of means for adjusting the location thereof for controlling the size of said initial forming angle.

15. The combination of claim 10 and wherein at least one press roll means engages said outer wire means at the region where it is wrapped partially around said cylinder means for pressing said outer wire means inwardly toward said axis of said cylinder means to increase the dewatering rate.

16. The combination of claim 10 and wherein an adjusting means is operatively connected with said outer wire means for adjusting the tension thereof so as to control the compression of the web between said outer wire means and said cylinder means.

17. The combination of claim 10 and wherein said slice is defined in part by a lower lip situated next to said cylinder means, and apron rubber means carried by said lower lip and situated between the latter and said cylinder means.

18. The combination of claim 10 and wherein said endless outer wire means has an upper run which includes the portion wrapped partially around said cylinder means and a lower run situated beneath said upper run, and saveall means situated beneath said upper run of said outer wire means between said upper run and said lower run for receiving material which falls through said upper run of said outer wire means during dewatering of the web between said outer wire means and said cylinder means.

19. The combination of claim 10 and wherein a means is situated over said cylinder means between said headbox means and said outer wire means for directing hot water jets onto the web traveling on said cylinder means from said headbox means to said endless outer wire means, for promoting dewatering of the web prior to engagement thereof by said outer wire means.

20. The combination of claim 10 and wherein said pickup roll means applies suction through the web and outer wire means inwardly toward the axis of said pickup roll means.

* * * * *